United States Patent [19]

Hager

[11] Patent Number: 4,491,080

[45] Date of Patent: Jan. 1, 1985

[54] SEWING MACHINE WITH EQUIPMENT FOR PRODUCING CORNER SEAMS

[75] Inventor: Walter Hager, Kaiserslautern, Fed. Rep. of Germany

[73] Assignee: Pfaff Industriemaschinen GmbH, Fed. Rep. of Germany

[21] Appl. No.: 449,830

[22] Filed: Dec. 14, 1982

[30] Foreign Application Priority Data

Dec. 18, 1981 [DE] Fed. Rep. of Germany ..... 3150141

[51] Int. Cl.[3] ..... D05B 69/22

[52] U.S. Cl. ..... 112/275; 112/121.11

[58] Field of Search ..... 112/121.11, 121.12, 112/272, 275, 277, 2, 262.1

[56] References Cited

U.S. PATENT DOCUMENTS

| | | | |
|---|---|---|---|
| 4,160,424 | 7/1979 | Newell et al. | 112/275 |
| 4,178,862 | 12/1979 | Bianchi et al. | 112/121.11 |
| 4,226,197 | 10/1980 | Pollmeier et al. | 112/121.11 |
| 4,359,953 | 11/1982 | Martell et al. | 112/275 X |
| 4,381,719 | 5/1983 | Goldbeck | 112/121.11 |

*Primary Examiner*—Peter Nerbun

*Attorney, Agent, or Firm*—McGlew and Tuttle

[57] ABSTRACT

A sewing machine is with a device for producing corner seams comprising a sensor which is located ahead of the needle and which releases the operation of stopping the needle at a predetermined corner point as soon as an edge of the work passes by. To exactly control the sticking in of the needle at a predetermined corner location, a pulse generator for delivering counting pulses and coupled to the main shaft of the sewing machine, is connected through a switching element to a setting counter, and is effective only during the advance phases of the feed dog motion. In addition, the sensor is connected to the switching element to switch it on as soon as the oblique edge of the work passes by, and the setting counter is connected to a device for instantly stopping the advancing effect of the feed dog, and to a device for stopping the sewing machine in the lowermost position of the needle, to release the operation of these devices as soon as a presettable number of pulses is reached. To instantly stop the advancing effect of the feed dog, the feed dog is connected to its lifting drive through a toggle lever which can be swung out by means of an actuating member controlled by the setting counter.

18 Claims, 4 Drawing Figures

SEWING MACHINE WITH EQUIPMENT FOR PRODUCING CORNER SEAMS

FIELD AND BACKGROUND OF THE INVENTION

The present invention relates in general to sewing machines and in particular to a new and useful sewing machine equipped with a device for producing corner seams.

Such devices include a sensor which is located ahead of the needle in the stitching direction, which sensor is operable to release mechanisms for stopping the needle at a predetermined corner point of a work or workpiece, as soon as an edge of the work or workpiece passes the sensor.

In a prior art arrangement of this kind (U.S. Pat. No. 4,226,198), a sensor releases certain operations for stopping the needle during the production of the last stitch to be made. Upon finishing the last stitch, the feed is stopped. The last perforation made when the needle has stopped is therefore mostly off a desired exact distance from the work edge which was sensed and which caused the stop. This distance can be anywhere within a zone spanning the complete stitch length, since the stitch which was already started must be finished.

For this reason, the sensor of the prior art, was usually placed so as to release the mentioned operation already in advance of the corner position, wherefore the last perforation by the needle is made somewhere in the area within a half stitch length before and behind the exact corner position. Such a stitch results in an unfavorable aspect of the corner seam and will frequently be rejected. Since the sewing machine, normally running at a high speed, cannot be stopped instantly, another sensor must be provided in addition, upstream of the first one, to reduce the speed of the machine some stitches before the stopping of the needle. Only then can the stopping operation depending on a response of the first sensor, follow.

SUMMARY OF THE INVENTION

The present invention is directed to a device for controlling a corner sewing operation, by which to form the last stitch, the needle is caused to pierce the work exactly at the predetermined corner point. This is the only way in which a satisfactory seam image can be obtained.

Accordingly, an object of the present invention is to provide a sewing machine with a device for producing corner seams which comprises a sensor located upstream of a sewing needle of the sewing machine in a feed direction of a workpiece or work to be sewn, a pulse generator which is coupled to the main shaft or other drive means of the sewing machine for delivering counting pulses at least during a movement of the feed dog in the feeding direction, feed stopping means engageable with the feed dog for instantaneously stopping the feeding effect thereof on the workpiece, stitch stopping means for stopping the main shaft or drive means in a lower position of the needle, a setting counter connected to the feed and stitch stopping means for activation thereof upon the counting of a selected number of pulses, and switching means connected to the sensor, the feed and stitch stopping means and the setting counter for causing the setting counter to count pulses coming from the pulse generator upon the sensing by the sensor of the passing of an edge of the workpiece, so that after the counting of the selected number of pulses by the setting counter, the feeding effect of the feed dog is stopped and the needle is stopped in its lower position. In this way while forming the last stitch, the needle necessarily penetrates the work at the corner poing of the seam. There is no need for any manipulation by the operator to this effect.

The central control using a microprocessor of the needed input and control elements reduces the costs of interconnection to a minimum.

According to the invention, an activating shaft is coupled to a measuring member such as a potentiometer, by which the presetting counter is effected through a microprocessor acting as the switching means. This extraordinarily simplifies the setting of the counter for changing the stitch lengths as required.

Another object of the invention is to provide a simple and effective solution for eliminating the action of the feed dog near the corner position of the seam. This is effected by providing the feed dog with a toggle arrangement having a joint pin that can be swung out by means of an actuating member controlled by the setting counter.

A still further object of the invention is to provide a sewing machine with a device for producing corner seams which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

One embodiment of the invention is shown in the drawings in which.

DESCRIPTION OF THE PREFERRED EMBODIMENT

Figure 1:
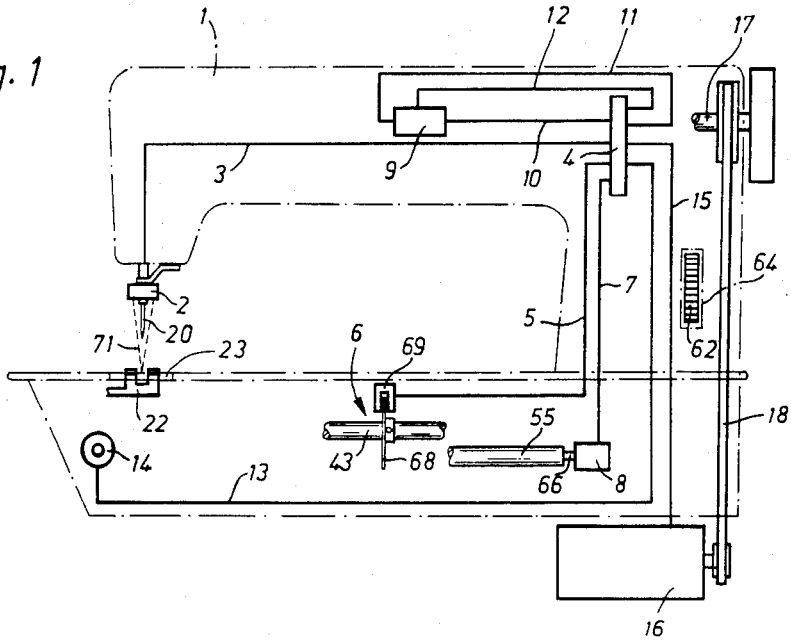
FIG. 1 is a fragmentary side elevational view showing the different control members needed for sewing a work corner, and their interconnection, diagrammatically.

According to FIG. 1, the different elements needed for controlling the corner sewing operation and their electric connections are accommodated in a housing indicated at 1. A sensor 2 is secured to housing 1 and connected through a line 3 to an input of a microprocessor 4. A pulse generator 6 is connected to another input of microprocessor 4 through line 5, and to still another input, a potentiometer 8 is connected through a line 7. A setting counter 9 is connected through a line 10 to an input of microprocessor 4, and through a line 11 to an output thereof. Through a further line 12 connected to another output of microprocessor 4, counter 9 can be set to a predeterminable number of pulses. From other outputs of microprocessor 4, a line 13 leads to an electromagnet 14, and a line 15 leads to a switch of a motor 16 driving the main shaft 17 of the sewing machine through a V-belt 18.

The microprocessor 4 processes the pulses incoming from pulse generator 6 and sensor 2 in accordance with a program, in a manner known per se. In addition, the microprocessor receives values which depending on the angular position of potentiometer 8 and simulate the adJusted stitch length. The stitch length may be entered instead through potentiometer 8, into the microprocessor by the operator, manually, of course.

Figures 2, 4:
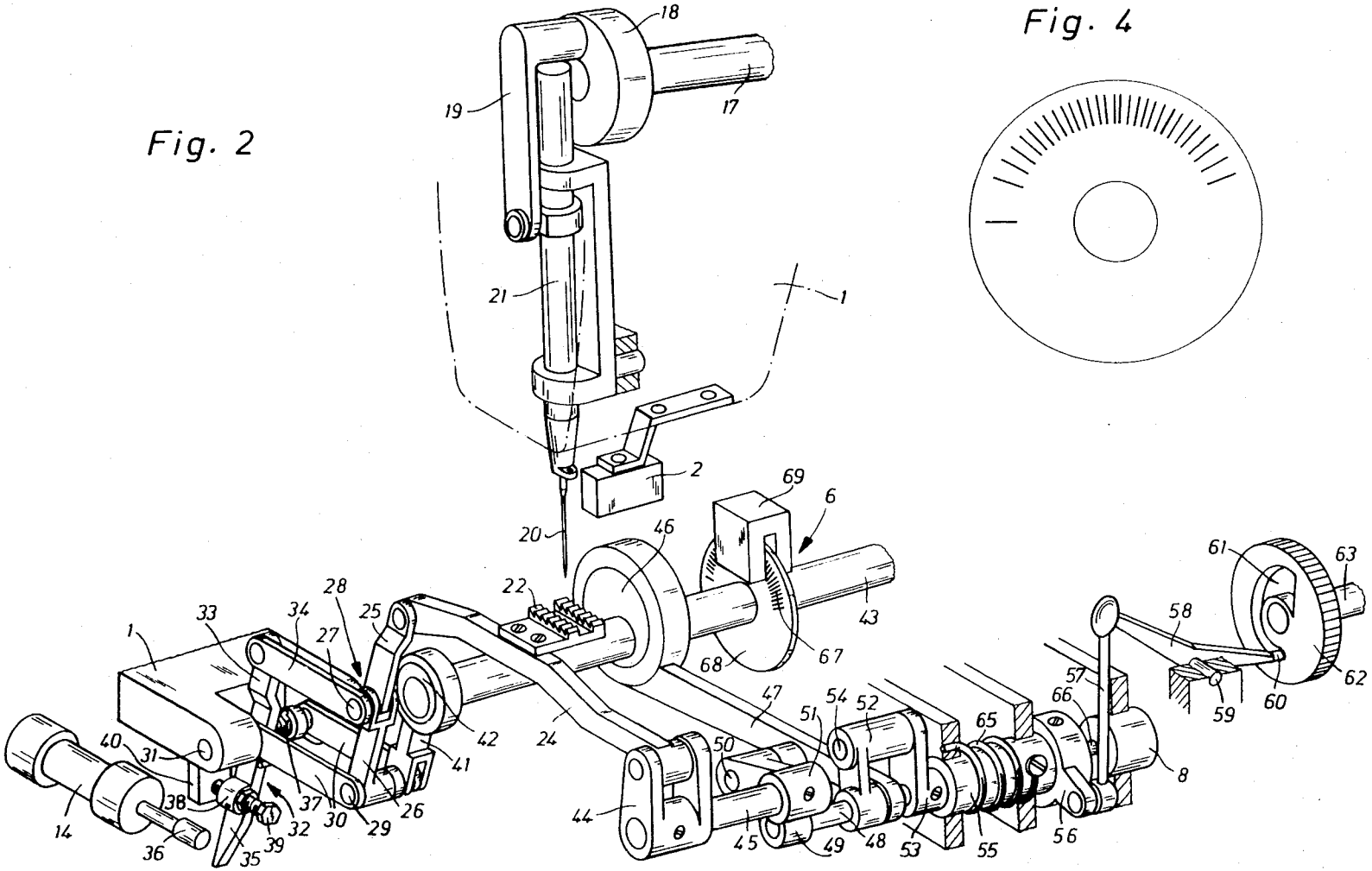
FIG. 2 is a perspective view of the drive mechanism of the sewing machine.
FIG. 4 shows an advantageous design of the pulse disc.

As shown in FIG. 2, main shaft 17 of the sewing machine, which is mounted in housing 1, drives a needle bar 21 which is equipped with a needle 20 through a crank 18 and a link 19.

Needle 20 cooperates with a feed dog 22 which is firmly screwed to a carrier 24 (FIG. 2) mounted beneath needle plate 23 (FIG. 1). Carrier 24 is connected by one of its end to a toggle lever 28, which comprises an upper part 25, a lower part 26, and a joint pin 27, and is connected through a bolt 29 to a pair of links 30. Links 30 are supported by a shaft 31 firmly secured to a housing 1. A double lever 32 is mounted on shaft 31, whose upper arm 33 extends parallel to lower part 26 of toggle lever 28 and has an effective length indentical with that of lower part 26. Upper lever arm 33 and joint pin 27 are connected to each other through a link 34 having the same length as links 30. Upper lever arm 33 and lower part 26 as well as link 34 and links 30 form a parallelogram linkage.

Arm 35 of toggle lever 32 projects into the path of motion of the plunger 36 of an electromagnet 14 which is secured to sewing machine housing 1. Shaft 31 carries a torsion spring 37 by which a set screw 39 adjustably received in a projection 38 of arm 35 of double lever 32, is held in contact with a stop 40 of housing 1.

An eccentric link 41 is hinged to bolt 29 and embraces an eccentric 42. Eccentric 42 is secured to a shaft 43 which is mounted in housing 1 of the sewing machine and driven by main shaft 17 in synchronism therewith. Eccentric 42 imparts a lifting motion to feed dog 22 at every stitch forming cycle.

Carrier 24 is connected to a forked crank 44 which is secured to an oscillating shaft 45 mounted in housing 1. To drive oscillating shaft 45, an eccentric 46 is secured to shaft 43 and the eccentric link 47 embracing eccentric 46 is hinged to a pin 48. Pin 48 carries a link 49 which is connected through a pin 50 to a crank 51 secured to oscillating shaft 45. Laterally of eccentric link 47, another link 52 is secured to pin 48. Link 52 embraces a pin 54 which is carried by a crank 53. As may be learned from FIG. 2, the effective lengths of links 49 and 52 are equal to each other, so that with pins 50 and 54 in mutual alignment, oscillating shaft 45 does not move, in spite of the motion of eccentric link 47.

To vary the motion of eccentric link 47 producing effect on oscillating shaft 45, crank 53 is clamped to a setting shaft 55 which is mounted in housing 1 and carries a setting crank 56. Setting crank 56 is connected through a ball-headed rod 57 to one end of a swing lever 58 which is pivotable about a fixed axis 59. At the other end, swing lever 58 has a ball-joint head 60 projecting between the side walls of a setting groove 61 of an adjustable setting wheel 62. Wheel 62 is carried on a fixed pin 63 and protrudes out of housing 1, through an opening 64, as shown in FIG. 1. Setting groove 61 (FIG. 2) in setting wheel 62 has a spiral configuration about the wheel axis, so that stitch lengths of 1 to 6 mm, for example, may be adjusted on feed dog 22. A torsion spring 65 secured between setting shaft 55 and housing 1 holds ball-point head 60 of swing lever 58 in permanent contact with one of the side walls of setting groove 61.

In axial extension of setting shaft 55, potentiometer 8 is secured to housing 1. The setting member 66 of the potentiometer is secured in an axial bore of shaft 55.

Shaft 43 carries a pulse disc 68 which forms a part of pulse generator 6 and is provided with division marks 67. Pulse generator 6 further carries a light scanner 69 responsive to division marks 67. Marks 67 are provided on only a part of pulse disc 68, namely that part which moves past scanner 69 during the feed phase of feed dog 22. Pulse generator 6 thus delivers pulses to microprocessor 4 only during the feed phase of the sewing machine. A pulse generator delivering pulses continually during the rotation of shaft 23 may also be provided, of course, only then it must be ensured that the pulses are prevented from passing through line 5 to microprocessor 4 during the non-feed phase of the sewing machine.

To relate the delivered pulses exactly proportionally to the portions of an advance step of feed dog 22, division marks 67 are advantageously spaced from each other by unequal angular distances as shown in FIG. 4, corresponding to the non-uniform advance motion of the feed dog. The angular distance between two adjacent division marks 67 corresponds to a constant portion of a single feed step of feed dog 22.

Spaced apart from the path of motion of needle 20, sensor 2 comprising a light transmitter and a light receiver, is secured to housing 1 of the sewing machine. Sensor 2 cooperates with a reflex foil 70 which is secured to needle plate 23 (FIG. 3) of the sewing machine. A light beam 71 issuing from the light transmitter of sensor 2 (FIG. 1) falls on a sensing spot 72, shown in FIG. 3, and if no work is present, is reflected from foil 70 back to the receiver of sensor 2. If during a work feed, an edge 73 of the work 74, such as shirt cellar, moves over sensing spot 73, the work 74 interrupts the light beam 71 and sensor 2 delivers a switching pulse through line 3 to microprocessor 4.

Figure 3:
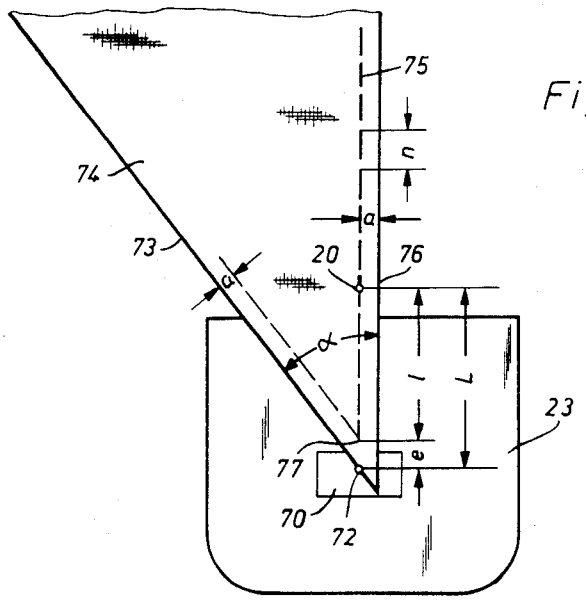
FIG. 3 is a diagrammatic illustration of a corner seam.

FIG. 3 shows how a corner seam is made with the inventive sewing machine. While producing a seam formed of individual stitches extending at a distance a from edge 76 of a work 74, sensor 2 signals, for example (see also FIG. 1), that the edge 73 of work 74 has cleared sensing spot 72 on needle plate 23, or on reflex foil 70 adhering thereto, by delivering a switching pulse through line 3 to microprocessor 4. Through line 15, microprocessor 4 switches drive motor 16 to a predetermined low speed at which the sewing machine can later be stopped within a single stitch.

Simultaneously, setting counter 9 is connected by microprocessor 4 through lines 11 and 5 to pulse generator 6. Now, as the sewing operation continues, the pulses delivered by pulse generator 6 effect a countdown in setting counter 9.

Under normal circumstances, the switching on of setting counter 9 will be effected within the feed phase of the sewing machine, since only during this phase, the work 74 may pass over sensing spot 72. FIG. 3 shows the position of needle 20 at the instant at which setting counter 9 is switched on. Now, the sewing machine continues to sew, and form normal stitches, until the countdown in setting counter 9 of the pulses delivered by pulse generator 6 during the feed phase is terminated. Then, setting counter 9 delivers a pulse through line 10 to microprocessor 4, to energize in a suitable way electromagnet 14 (FIG. 2) through line 15. Plunger 36 is thereby pushed out and double lever 32 projecting into the path of motion of the plunger is pivoted about axis 31, against the action of spring 37. Link 34, which is connected to lever 32, moves joint pin 27, thereby folding toggle lever 28 inwardly. Due to the abrupt reduction of the effective length of toggle lever 28, feed dog 22 is pulled without delay below the surface of needle plate 23, where it continues to perform the feed motion without producing an effect.

Simultaneously with the energizing of electromagnet 14 (FIG. 1), microprocessor 4 delivers through line 15 an instruction for switching off drive motor 16, whereupon, in a manner known per se, the sewing machine is stopped in the next lowermost position of needle 20. This interrupts the last stitch advance motion at the predetermined corner point 77 (FIG. 3), while the sewing machine finishes the stitch formation and holds needle 20 stopped in the lowermost position to make possible a following turning of work 74. Therefore, the last stitch ends exactly at the predetermined corner point 77, even though its length may be reduced as compared to the other, normal stitches.

Even if the switch-off instruction is given only at the end of the feed phase, and the sewing machine, because of its inertia forces, cannot stop within the residual portion of the motion leading to the lowermost position of needle 20, so that another stitch is formed in addition, the feed motion remains interrupted. Another stitch is formed at corner point 77, which, however, is not perceptible in the finished work 74.

Prior to producing this seam, counter 9 must be set to a predetermined terminal number. This terminal number depends on the distance L between needle 20 (FIG. 3) and sensing spot 72 of sensor 2, on the distance e between corner point 77 and edge 73 of work 74, on the adjusted stitch length n , and finally on the present number of pulses i per stitch formation.

Distance L is constant. The residual seam length l is the distance between needle 20 and the predetermined corner point 77. The pulse number i per stitch formation depends on the employed pulse generator. Distance e depends on the margin a between the seam and edge 73 or 76 and on the angle $\alpha$ between the two edges. While introducing a correction factor $k=1/\sin\alpha$ distance e equals a·k independently of whether angle $\alpha$ is acute or obtuse.

The residual seam length l to be produced after switching on setting counter 9 is therefore $l=L-(a\cdot k)$ in millimeters.

The correction factor k may be entered into microprocessor 4 in a suitable manner through keys. However, it is also possible to scan the edge 73 of work 74 by means of another sensor which is provided between needle 20 and first sensor 2, only at a laterally offset location, and to determine angle alpha, wherefrom the correction factor k may be computed by microprocessor 4.

While adjusting the actual stitch length by means of setting wheel 62 (FIG. 2), setting shaft 55 is turned, through swing lever 58, connecting rod 57, and setting crank 56. This correspondingly changes the resistance of potentiometer 8 which is connected to setting shaft 55. This value is entered as input into microprocessor 4, through line 7 (FIG. 1).

With an adjusted stitch length n in millimeters, and a predetermined number of pulses i per stitch formation depending on the employed pulse generator, the total number of pulses I at setting counter 9 is $I=i(L-(a\cdot k)/n$.

Upon recalling the predetermined or set parameters, microprocessor 4 computes the total number of pulses I and sets the counter 9 to this number of pulses, through line 12.

While a specific embodiment of the invention has been shown and described in detail to illustrate the application of the principles of the invention, it will be understood that the invention may be embodied otherwise without departing from such principles.

What is claimed is:

1. In a sewing machine having a needle, drive means for driving the needle between an upper and a lower position thereof for making stitches, a feed dog for feeding a workpiece in a feeding direction for making stitches, the workpiece having at least two edges extending at an angle and meeting in a corner area, and dog moving means for moving feed dog, a device for producing corner seams comprising:

a sensor for sensing the passing of one of the workpiece edges, positioned upstream of the needle in the feeding direction;

a pulse generator operatively coupled to the drive means for delivering a plurality of counting pulses only during a movement of the feed dog in the direction to make a stitch;

feed stopping means connected to the feed dog for instantaneously stopping feeding effect of the feed dog on the workpiece in the feeding direction;

stitch stopping means for stopping the drive means in a lower position of the needle;

a setting counter connected to said feed and stitch stopping means for activation thereof upon the counting of a selected number of pulses from said pulse generator; and switching means connected to said sensor, said pulse generator and said setting counter, operable upon the sensing by said sensor of the passing of an edge of the workpiece to cause said setting counter to count pulses from said pulse generator.

2. The device according to claim 1, wherein said switching means comprise a microprocessor.

3. The device according to claim 1, wherein said switching means is connected to the drive means of the sewing machine of the sewing machine for instantaneously reducing the speed of the drive means upon the sensing, by said sensor, of the passing of an edge of the workpiece.

4. The device according to claim 1, wherein the drive means of the sewing machine comprises a motor operatively connected to a main shaft, said pulse generator coupled to said main shaft for generating a plurality of pulses with each rotation of said main shaft.

5. The device according to claim 4, including a measuring member movable to set the selected number of pulses counted by said setting counter, an actuating shaft connected to said member for movement of said measuring member with rotation of said activating shaft, said activating shaft connected to the dog moving means for moving the feed dog to change the length of a stitch formed by the sewing machine with changing of a selected number of pulses counted by said setting counter.

6. The device according to claim 1, including a lifting drive connected to the feed dog having a toggle lever including a joint pin which can be swung out to lower the feed dog away from a workpiece and thus to prevent effectiveness of the feed dog from moving a workpiece in the feeding direction, and an actuating member connected to said setting counter and said joint pin for swinging said joint pin out upon counting by said setting counter of said selected number of pulses.

7. The device according to claim 1, wherein said pulse generator is operable to generate pulses during advancing of a workpiece by the feed dog in the feeding direction, the feed dog including a plurality of advancing steps, said pulses timed to correspond respectively the movement of each advance step in the feeding direction.

8. The device according to claim 7, wherein the drive means of the sewing machine includes a rotatable main shaft, said pulse generator comprising a disc rotating in synchronism with said main shaft and pulse delivering means associated with said disc, said disc including angularly distributed markers operable to generate a pulse each time a marker passes pulse delivering means, said markers positioned on an angular zone of said disc corresponding to feeding by said feed dog in said feeding direction.

9. A sewing machine with a sewing needle and a device for producing corner seams, comprising, a sensor located ahead of the needle in a work feeding direction and effective to release an operation of stopping the needle at a predetermined corner on a work as soon as an edge of the work passes the sensor, a pulse generator for delivering plural counting pulses which is effective only during the advance phases of a feed dog of the sewing machine and is coupled to a main shaft of the sewing machine, a switching element connected to the pulse generator, a setting counter connected to the switching element, the sensor being connected to the switching element and being operable to switch the element on as an angled edge of the work passes the sensor and the setting counter being connected to means for instantaneously stopping the advancing effect of the feed dog as well as to means for stopping the sewing machine in the lowermost position of the needle, in order to release the actuation of these means as soon as a presettable number of pulses is reached.

10. A sewing machine according to claim 9, wherein a microprocess is provided as the switching element and controlling the means for stopping the advance effect of the feed dog and the means for stopping the sewing machine.

11. A sewing machine according to claim 10, including an actuating shaft coupled to a measuring member by which the presetting of the setting counter is effected through the microprocessor.

12. A sewing machine according to claim 9, wherein the feed is connected to a drive through a toggle lever including a joint pin which can be swung out by means of an actuating member controlled by the setting counter to lower the dog away from work to be fed.

13. A sewing machine according to claim 9, wherein the pulse generator includes a subdivision of the counting pulses delivered within the advance phase of a work in a manner corresponding to uniform portions of an advance step of the feed dog.

14. A sewing machine according to claim 13, wherein the pulse generator comprises a disc which rotates in synchronism with the main shaft and is equipped with pulse delivering means which are provided on the disc in an angular zone effective only during the advance step of the feed dog and which are spaced from each other by angular distances corresponding to constant partial amounts of an advance step of the feed dog.

15. A method of operating a sewing machine having a needle, drive means for driving the needle to make stitches, a feed dog for feeding a workpiece in a feeding direction, the workpiece having at least two edges meeting in a corner zone and dog moving means connected to the feeding dog for moving the workpiece in the feeding direction, the sewing machine operated to produce a corner seam, comprising steps of:

sensing the passing of one of the workpiece edges at a location in the feeding direction upstream of the needle;

generating plural pulses during the movement of the feed dog in the feeding direction;

initiating the counting of a select number of the pulses upon the sensing by the sensor of the passing of the edge of the workpiece;

instantaneously stopping the effectiveness of the feed dog to feed a workpiece in the feed direction upon the counting of said selected number of pulses; and stopping the drive means of the sewing machine with the needle in the lowermost position upon the counting of the selected number of pieces.

16. A method according to claim 15, including changing the selected number of pulses counted in a manner dependent on the length of the stitches made by the sewing machine, the angle at which the workpiece edges eat in the corner area, and the distance between a seam to be sewn and the workpiece edges.

17. A method according to claim 15, including slowing the sewing machine drive means from an initial sewing speed to a reduced speed upon the sensing of the passing of the workpiece edge.

18. A method according to claim 15, including controlling the counting, workpiece feeding and needle stopping functions using a microprocessor.

* * * * *